US006928983B2

(12) United States Patent
Mashiki

(10) Patent No.: US 6,928,983 B2
(45) Date of Patent: Aug. 16, 2005

(54) FUEL INJECTION CONTROLLER FOR INTERNAL COMBUSTION ENGINE

(75) Inventor: Zenichiro Mashiki, Nisshin (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/990,973

(22) Filed: Nov. 18, 2004

(65) Prior Publication Data

US 2005/0109320 A1 May 26, 2005

(30) Foreign Application Priority Data

Nov. 21, 2003 (JP) ..... 2003-392356

(51) Int. Cl.[7] ..... F02B 7/00
(52) U.S. Cl. ..... 123/431; 123/300; 701/104
(58) Field of Search ..... 123/295, 299, 123/300, 304, 431; 701/103, 104, 105

(56) References Cited

U.S. PATENT DOCUMENTS 5,875,743 A * 3/1999 Dickey ..... 123/25 C
6,318,306 B1 * 11/2001 Komatsu ..... 123/3
6,463,907 B1 * 10/2002 Hiltner ..... 123/304
6,666,185 B1 * 12/2003 Willi et al. ..... 123/299
6,679,224 B2 * 1/2004 Stanglmaier ..... 123/431
6,786,201 B2 * 9/2004 Ohtani ..... 123/431
6,799,558 B2 * 10/2004 Gmelin et al. ..... 123/431
6,866,016 B2 * 3/2005 Cueman ..... 123/299
2004/0194737 A1 * 10/2004 Miyashita ..... 123/48 C

FOREIGN PATENT DOCUMENTS

JP 05-231221 2/1992
JP 10-103118 9/1996
JP 2000-179368 * 6/2000 ..... F02D 19/08
JP 2002-47973 8/2000
JP 2000-265877 * 9/2000 ..... F02D 41/06

* cited by examiner

*Primary Examiner*—Hai Huynh
(74) *Attorney, Agent, or Firm*—Kenyon & Kenyon

(57) ABSTRACT

In an engine including a passage injector and an in-cylinder injector that allocates and injects fuel, a fuel injection controller prevents the fuel injection amount of each injector from falling below an allowable lower limit value. When the fuel injection amount of one of the passage injector and the in-cylinder injector becomes less than or equal to a value indicating the possibility of the fuel injection amount falling to less than an allowable lower limit value due to correction with the correction value, the fuel injection amount of only the other one of the passage injector and the in-cylinder injector is corrected with the correction value.

29 Claims, 8 Drawing Sheets

Passage Injection Command Value Q1
Predetermined Value B
Allowable Lower Limit Value mim1

Passage Injection Correction Value FAF1
1.0

In-Cylinder Injection Command Value Q2
Predetermined Value A
Allowable Lower Limit Value mim2

In-Cylinder Correction Value FAF2
1.0
T1
Time

Passage Injection Command Value Q1
Predetermined Value B
Allowable Lower Limit Value mim1

Passage Injection Correction Value FAF1
1.0

In-Cylinder Injection Command Value Q2
Predetermined Value A
Allowable Lower Limit Value mim2

In-Cylinder Correction Value FAF2
1.0
T2
Time

Passage Injection Command Value Q1
Allowable Lower Limit Value mim1
S1

Passage Injection Correction Value FAF1
1.0

In-Cylinder Injection Command Value Q2
S1

In-Cylinder Correction Value FAF2
1.0
T3
Time

Passage Injection Command Value Q1
S2

Passage Injection Correction Value FAF1
1.0

In-Cylinder Injection Command Value Q2
Allowable Lower Limit Value mim2
S2

In-Cylinder Correction Value FAF2
1.0
T4
Time

FUEL INJECTION CONTROLLER FOR INTERNAL COMBUSTION ENGINE

BACKGROUND OF THE INVENTION

The present invention relates to a fuel injection controller for an internal combustion engine, and more specifically, to a fuel injection controller for internal combustion engines including a passage injector for injecting fuel into an intake passage and an in-cylinder injector for injecting fuel into a combustion chamber.

Japanese Patent No. 3060960 (Japanese Laid-Open Patent Publication No. 10-103118) describes an internal combustion engine provided with a passage injector for injecting fuel into an intake passage (for example, an intake port) and an in-cylinder injector for injecting fuel into a combustion chamber. The passage injector and in-cylinder injector allocate and inject fuel as necessary.

Even in this internal combustion engine, air-fuel ratio feedback control is performed similar to conventional internal combustion engines provided with a single injector. In air-fuel ratio feedback control, the amount of injected fuel is corrected using a feedback correction value, which changes according to the air-fuel ratio, so as to have the air-fuel ratio approach a target value. That is, the amount of fuel injected by the passage injector and the amount of fuel injected by the in-cylinder injector are corrected by the feedback correction value such that the air-fuel ratio approaches a target value in the internal combustion engine.

When fuel is allocated and injected by the passage injector and in-cylinder injector, less fuel is injected by one injector than when fuel is injected by a single injector. Accordingly, the amount of fuel injected by each injector may be less than an allowable lower limit due to the correction performed using the feedback correction value. The allowable lower limit value represents the minimum value of the quantity of injected fuel that can be accurately controlled and is determined in accordance with the injector.

SUMMARY OF THE INVENTION

The present invention provides a fuel injection controller for preventing the amount of fuel injected by each injector from becoming lower than the allowable lower limit when the passage injector and in-cylinder injector allocate and inject the fuel.

one aspect of the present invention is a controller for controlling fuel injection in an engine. The engine includes an intake passage, a combustion chamber, a passage injector for injecting fuel into the intake passage, and an in-cylinder injector for injecting fuel into the combustion chamber. The controller includes a control means for controlling the passage injector and the in-cylinder injector so that the passage injector and the in-cylinder injector allocate and inject fuel. A correction means corrects the fuel injection amount for the engine with a correction value that is based on an air-fuel ratio in the engine. The correction means corrects a fuel injection amount of only one of the injectors among the passage injector and the in-cylinder injector with the correction value when the fuel injection amount of the other one of the injectors among the passage injector and the in-cylinder injector is less than or equal to a value that indicates the possibility of the fuel injection amount falling below an allowable lower limit value due to correction with the correction value.

Another aspect of the present invention is a control apparatus for controlling fuel injection in an engine. The engine includes an intake passage, a combustion chamber, a passage injector for injecting fuel into the intake passage, and an in-cylinder injector for injecting fuel into the combustion chamber. The control apparatus includes a controller for controlling the passage injector and the in-cylinder injector so that the passage injector and the in-cylinder injector allocate and inject fuel. The controller corrects the fuel injection amount for the engine with a correction value that is based on an air-fuel ratio in the engine. The controller corrects a fuel injection amount of only one of the injectors among the passage injector and the in-cylinder injector with the correction value when the fuel injection amount of the other one of the injectors among the passage injector and the in-cylinder injector is less than or equal to a value that indicates the possibility of the fuel injection amount falling below an allowable lower limit value due to correction with the correction value.

Another aspect of the present invention is a controller for controlling fuel injection in an engine. The engine includes an intake passage, a combustion chamber, a passage injector for injecting fuel into the intake passage, and an in-cylinder injector for injecting fuel into the combustion chamber. A fuel injection amount for the engine is corrected with a correction value that is based on an air-fuel ratio in the engine. The controller includes a correction means for correcting a fuel injection amount of only one of the injectors among the passage injector and the in-cylinder injector with the correction value when the fuel injection amount of the other one of the injectors among the passage injector and the in-cylinder injector is less than or equal to a value that indicates a possibility of the fuel injection amount falling below an allowable lower limit value due to correction with the correction value. At least one sensor is in communication with the correction means to provide engine information.

Another aspect of the present invention is a control apparatus for controlling fuel injection in an engine. The engine includes an intake passage, a combustion chamber, a passage injector for injecting fuel into the intake passage, and an in-cylinder injector for injecting fuel into the combustion chamber. A fuel injection amount for the engine is corrected with a correction value that is based on an air-fuel ratio in the engine. The control apparatus includes a controller for correcting a fuel injection amount of only one of the injectors among the passage injector and the in-cylinder injector with the correction value when the fuel injection amount of the other one of the injectors among the passage injector and the in-cylinder injector is less than or equal to a value that indicates a possibility of the fuel injection amount falling below an allowable lower limit value due to correction with the correction value. At least one sensor is in communication with the controller to provide engine information.

A further aspect of the present invention is a controller for controlling fuel injection in an engine. The engine includes an intake passage, a combustion chamber, a passage injector for injecting fuel into the intake passage, and an in-cylinder injector for injecting fuel into the combustion chamber. The controller includes a correction means for correcting a fuel injection amount for the engine with a correction value that is based on an air-fuel ratio in the engine. A control means fixes a fuel injection amount of one of the injectors among the passage injector and the in-cylinder injector to an allowable lower limit value and decreases a fuel injection amount of the other one of the injectors among the passage injector and the in-cylinder injector when the fuel injection amount of the one of the injectors is less than an allowable lower limit value.

A further aspect of the present invention is a control apparatus for controlling fuel injection in an engine. The engine includes an intake passage, a combustion chamber, a passage injector for injecting fuel into the intake passage, and an in-cylinder injector for injecting fuel into the combustion chamber. The control apparatus includes a controller for correcting a fuel injection amount for the engine with a correction value that is based on an air-fuel ratio in the engine. The controller fixes a fuel injection amount of one of the injectors among the passage injector and the in-cylinder injector to an allowable lower limit value and decreases a fuel injection amount of the other one of the injectors among the passage injector and the in-cylinder injector when the fuel injection amount of the one of the injectors is less than an allowable lower limit value.

Another aspect of the present invention is a controller for controlling fuel injection in an engine. The engine includes an intake passage, a combustion chamber, a passage injector for injecting fuel into the intake passage, and an in-cylinder injector for injecting fuel into the combustion chamber. A fuel injection amount for the engine is corrected with a correction value that is based on an air-fuel ratio in the engine. The controller includes a control means for fixing a fuel injection amount of one of the injectors among the passage injector and the in-cylinder injector to an allowable lower limit value and decreasing a fuel injection amount of the other one of the injectors among the passage injector and the in-cylinder injector when the fuel injection amount of the one of the injectors is less than an allowable lower limit value. At least one sensor is in communication with the control means to provide engine information.

A further aspect of the present invention is a control apparatus for controlling fuel injection in an engine. The engine includes an intake passage, a combustion chamber, a passage injector for injecting fuel into the intake passage, and an in-cylinder injector for injecting fuel into the combustion chamber. A fuel injection amount for the engine is corrected with a correction value that is based on an air-fuel ratio in the engine. The control apparatus includes a controller for fixing a fuel injection amount of one of the injectors among the passage injector and the in-cylinder injector to an allowable lower limit value and decreasing a fuel injection amount of the other one of the injectors among the passage injector and the in-cylinder injector when the fuel injection amount of the one of the injectors is less than an allowable lower limit value. At least one sensor is in communication with the controller to provide engine information.

Another aspect of the present invention is a method for controlling fuel injection in an engine. The engine includes an intake passage, a combustion chamber, a passage injector for injecting fuel into the intake passage, and an in-cylinder injector for injecting fuel into the combustion chamber. The method includes controlling the passage injector and the in-cylinder injector so that the passage injector and the in-cylinder injector allocate and inject fuel, correcting the fuel injection amount for the engine with a correction value that is based on an air-fuel ratio in the engine, and correcting a fuel injection amount of only one of the injectors among the passage injector and the in-cylinder injector with the correction value when the fuel injection amount of the other one of the injectors among the passage injector and the in-cylinder injector is less than or equal to a value that indicates the possibility of the fuel injection amount falling below an allowable lower limit value due to correction with the correction value.

Another aspect of the present invention is a method for controlling fuel injection in an engine. The engine includes an intake passage, a combustion chamber, a passage injector for injecting fuel into the intake passage, and an in-cylinder injector for injecting fuel into the combustion chamber. The method includes correcting a fuel injection amount for the engine with a correction value that is based on an air-fuel ratio in the engine, and fixing a fuel injection amount of one of the injectors among the passage injector and the in-cylinder injector to an allowable lower limit value and decreasing a fuel injection amount of the other one of the injectors among the passage injector and the in-cylinder injector when the fuel injection amount of the one of the injectors is less than an allowable lower limit value.

A further aspect of the present invention is a method for controlling fuel injection in an engine. The engine includes an intake passage, a combustion chamber, a passage injector for injecting fuel into the intake passage, and an in-cylinder injector for injecting fuel into the combustion chamber. A correction value based on an air-fuel ratio is set for each of the passage injector and the in-cylinder injector. The method includes correcting a fuel injection amount for the engine with the correction value, determining whether a fuel injection amount of one of the injectors among the passage injector and the in-cylinder injector is less than a predetermined value when the passage injector and the in-cylinder injector are both injecting fuel, changing the correction value of the one of the injectors when the fuel injection amount of the one of the injectors is less than a predetermined value, and fixing the correction value of the other one of the injectors among the passage injector and the in-cylinder injector when the fuel injection amount of the one of the injectors is less than the predetermined value.

Another aspect of the present invention is a method for controlling fuel injection in an engine. The engine includes an intake passage, a combustion chamber, a passage injector for injecting fuel into the intake passage, and an in-cylinder injector for injecting fuel into the combustion chamber. A correction value based on an air-fuel ratio is set for each of the passage injector and the in-cylinder injector. The method includes correcting a fuel injection amount for the engine with the correction value, determining whether a fuel injection amount of one of the injectors among the passage injector and the in-cylinder injector is less than an allowable lower limit value when the passage injector and the in-cylinder injector are both injecting fuel, fixing the fuel injection amount of one of the injectors among the passage injector and the in-cylinder injector when the fuel injection amount of the one of the injectors is less than an allowed lower limit value, and changing the correction value of the other one of the injectors among the passage injector and the in-cylinder injector when the fuel injection amount of the one of the injectors is less than the allowed lower limit value.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
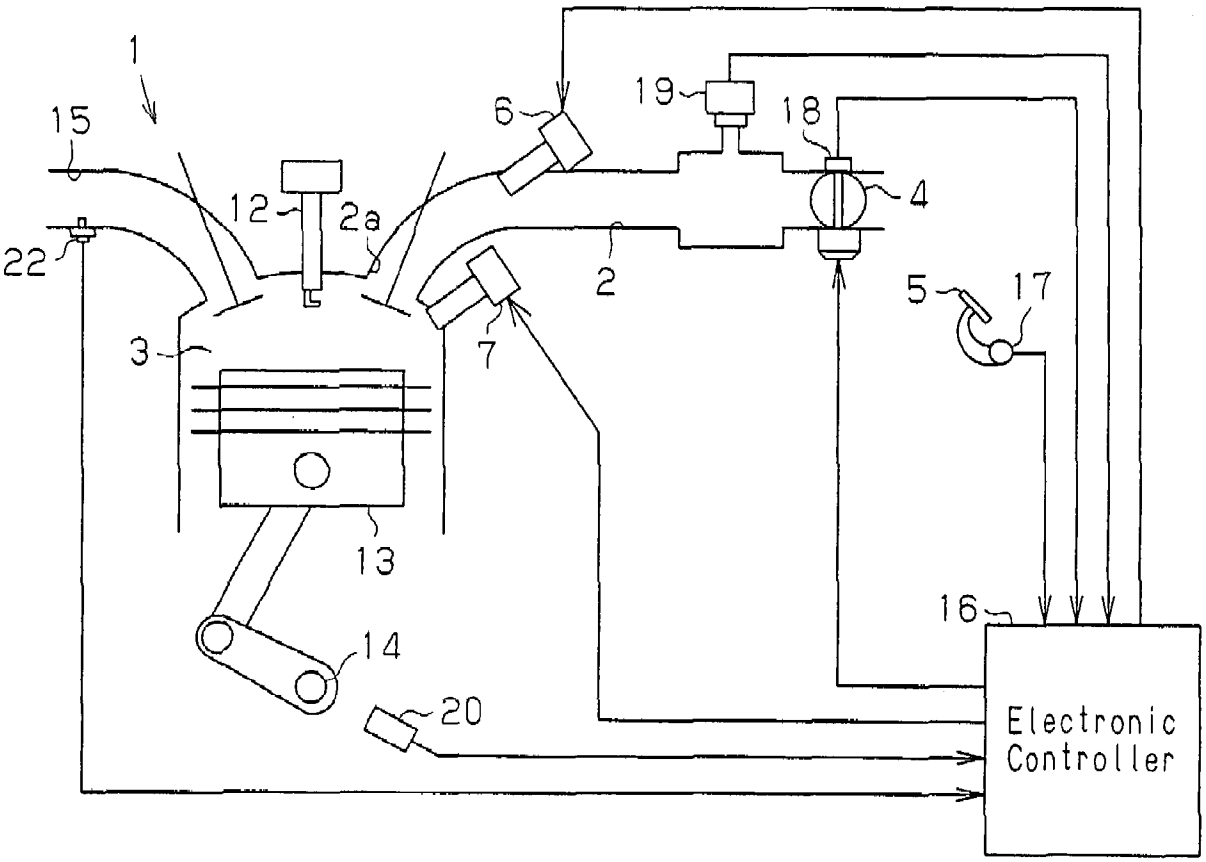
FIG. 1 is a schematic diagram showing an engine provided with a fuel injection controller according to a first embodiment of the present invention.

In the drawings, like numerals are used for like elements throughout.

First Embodiment

A fuel injection controller for an automobile engine according to a first embodiment of the present invention will now be described hereinafter with reference to FIGS. 1 through 5.

As shown in FIG. 1, an automobile engine 1 includes an intake passage 2, an exhaust passage 15, and a combustion chamber 3 connected to the intake passage 2 and exhaust passage 15. The intake passage 2 is provided with a throttle valve 4, which opens and closes to adjust the amount of air (amount of intake air) introduced into the fuel combustion chamber 3. The open amount (degree of opening of the throttle) of the throttle valve 4 is controlled in accordance with the depressed amount of an accelerator pedal 5, which is depressed by the driver of the vehicle. The engine 1 is provided with a passage injector 6 for injecting fuel toward the intake passage 2 (for example, toward an intake port 2*a* of the combustion chamber 3), and an in-cylinder injector 7 for injecting fuel into the combustion chamber 3. A spark plug 12 is arranged in the combustion chamber 3.

In the engine 1, a gaseous mixture formed of fuel injected from the injectors 6 and 7 and air flowing from the intake passage 2 is charged into the combustion chamber 3 and ignited by the spark plug 12. This burns the gaseous mixture and reciprocates a piston 13 with the combustion energy so as to rotate a crankshaft 14. The burned gaseous mixture is discharged through the exhaust passage 15.

An electronic controller 16 for performing various operation controls of the engine 1 is installed in the vehicle. The electronic controller 16 performs switching control of the injectors 6 and 7 and performs fuel injection control of the engine 1 by driving the injectors 6 and 7. The electronic controller 16 receives detection signals from various types of sensors that are listed below.

Accelerator position sensor 17 for detecting the depression amount of the accelerator pedal.

Throttle position sensor 18 for detecting the open amount of the throttle.

Vacuum sensor 19 for detecting the pressure downstream from the throttle valve 4 in the intake passage 2.

Crank position sensor 20 for generating a signal corresponding to the rotation of the crankshaft 14.

Oxygen ($O_2$) sensor 22 for generating a signal corresponding to the oxygen concentration in the exhaust gas flowing through the exhaust passage 15.

The switching control of the injectors 6 and 7 and the fuel injection control of the engine 1 performed by the electronic controller 16 are described below.

Injector Switching Control

Fuel is injected from either one of the passage injector 6 and the in-cylinder injector 7 or both injectors 6 and 7 in accordance with the operating conditions of the engine 1.

For example, when the coolant temperature of the engine 1 is relatively low, only the passage injector 6 injects fuel. When fuel is injected from the passage injector 6, the time from the injection of the fuel until the ignition of the fuel is relatively long. That is, it is relatively easy to ensure the time necessary for the fuel to be vaporized. Accordingly, under low engine temperature conditions, injected fuel is adequately vaporized, and as a result it is possible to suppress fumes that would be produced when burning liquefied fuel.

When the coolant temperature of the engine 1 is relatively high and the engine 1 is in an operating range requiring a small amount of injected fuel, only the in-cylinder injector 7 injects fuel. When the coolant temperature of the engine 1 is relatively high and the engine 1 is in an operating range requiring a large amount of injected fuel, the passage injector 6 and the in-cylinder injector 7 both inject fuel. When the in-cylinder injector 7 injects fuel, the injected fuel impinges the head of the piston 13 and the interior wall of the cylinder and is vaporized. Since the fuel captures the heat of vaporization from the piston 13 and the cylinder, the temperature decreases within the combustion chamber 3. As a result, intake air charging efficiency increases. This, in turn, increases the engine output. In the operating range requiring a small amount of injected fuel, when the two injectors 6 and 7 allocate and inject the fuel, the respective injectors 6 and 7 inject a small amount of fuel. In this case, there is concern that the amount of injected fuel will be less than the allowable lower limit, that is, less than the minimum amount of injected fuel that can be accurately controlled. Therefore, when the coolant temperature of the engine 1 is increased by a certain extent, only the in-cylinder injector 7 injects fuel in the operating range requiring a small amount of injected fuel.

When the passage injector 6 and in-cylinder injector 7 both allocate and inject fuel, the electronic controller 16 changes the ratio of the amount of fuel injected by the in-cylinder injector 7 relative to the amount of fuel injected by the passage injector 6 in accordance with the engine operating conditions, such as the engine speed and engine load. That is, the electronic controller 16 optimally controls the amount of fuel injected by each injector 6 and 7 according to the engine operating conditions.

Fuel Injection Control of Engine 1

The electronic controller 16 controls the amount of fuel injected in the engine 1. More specifically, the electronic controller 16 controls the amount of fuel injected by the passage injector 6 and the amount of fuel injected by the in-cylinder injector 7 so as to obtain a total fuel injection amount Qfin that is required under the operating conditions of the engine 1. The electronic controller 16 controls the fuel injected by the passage injector 6 by driving the injector 6 based on a passage injection command value Q1. The electronic controller 16 controls the fuel injected by the in-cylinder injector 7 by driving the injector 7 based on an in-cylinder injection command value Q2.

The relationship of the total fuel injection amount Qfin relative to the passage injection command value Q1 and the in-cylinder injection command value Q2 is expressed in the following equation (1).

$$Qfin=Q1+Q2 \quad (1)$$

In the equation, Qfin represents the total fuel injection amount, Q1 represents the passage injection command value, and Q2 represents the in-cylinder injection command value.

The passage injection command value Q1 is calculated by the following equation (2).

$$Q1=Qbse\cdot k\cdot FAF1\cdot A \quad (2)$$

In the equation, Q1 represents the passage injection command value, Qbse represents the basic amount of injected fuel, k represents the allocation coefficient, FAF1 represents the passage injection feedback correction value, and A represents another correction coefficient.

The in-cylinder injection command value Q2 is calculated by the following equation (3).

$$Q2=Qbse(1-k)\cdot FAF2\cdot B \quad (3)$$

In the equation, Q2 represents the in-cylinder injection command value, Qbse represents the basic amount of injected fuel, k represents the allocation coefficient, FAF2 represents the in-cylinder injection feedback correction value, and B represents another correction coefficient.

The basic amount of injected fuel Qbse of equations (1) and (2) is calculated based on parameters (engine operating conditions) including the engine speed and engine load. Further, the basic amount of injected fuel Qbse represents the theoretical total amount of injected fuel required under the engine operating conditions. The basic amount of injected fuel Qbse increases as the engine speed and load increase. The electronic controller 16 determines the engine speed based on detection signals from the crank position sensor 20. The electronic controller 16 calculates the engine load based on the engine speed and a parameter corresponding to the intake air amount of the engine 1. Examples of parameters corresponding to the intake air amount include the intake pressure of the engine 1 determined based on the detection signal from the vacuum sensor 19, the throttle opening amount determined based on the detection signal from the throttle position sensor 18, and the accelerator pedal depression amount determined based on the detection signal from the accelerator position sensor 17.

The allocation coefficient k in equation (1) is variable within a range of 0 to 1 according to the engine operating conditions. The allocation coefficient k determines the ratio of the amount of fuel injected by the passage injector 6. Accordingly, the passage injection command value Q1 calculated by equation (1) is a command value of the amount of fuel injected by the passage injector 6 that is necessary to obtain the total fuel injection amount Qfin. In equation (2), the factor [1-k] using the allocation coefficient k determines the ratio of the amount of injected fuel allocated to the in-cylinder injector 7. Accordingly, the in-cylinder injection command value Q2 calculated by equation (2) is a command value of the amount of fuel injected by the in-cylinder injector 7 necessary to obtain the total fuel injection amount Qfin.

When only the passage injector 6 injects fuel such as when the coolant temperature of the engine 1 is relatively low, the electronic controller 16 sets the allocation coefficient k at [1]. In this case, the electronic controller 16 sets the in-cylinder injection command value Q2 at [0]. The total fuel injection amount Qfin is ensured by having only the passage injector 6 inject fuel, and the passage injection command value Q1 is equal to the total fuel injection amount Qfin. When the coolant temperature of the engine 1 is relatively high and the engine operating conditions are in the range requiring a relatively small amount of injected fuel, the electronic controller 16 sets the allocation coefficient k to [0]. In this case, the electronic controller 16 sets the passage injection command value Q1 to [0]. The total fuel injection amount Qfin is ensured by having only the in-cylinder injector 7 inject fuel, and the in-cylinder injection command value Q2 is equal to the total fuel injection amount Qfin.

When the coolant temperature of the engine 1 is relatively high and the engine operating conditions are outside the range requiring a relatively small amount of injected fuel (that is, within a range requiring a relatively large amount of injected fuel), the electronic controller 16 variably sets the allocation coefficient k to a value greater than [0] and less than [1] in accordance with the engine load and the engine speed. The electronic controller 16 calculates the passage injection command value Q1 and the in-cylinder injection command value Q2 in accordance with the allocation coefficient k. In this case, the total amount fuel injection amount Qfin is ensured by the fuel injected by both of the passage injector 6 and the in-cylinder injector 7.

The passage injection feedback correction value FAF1 of equation (1) (hereinafter referred to as passage injection correction value FAF1) and the in-cylinder injection feedback correction value FAF2 of equation (2) (hereinafter referred to as in-cylinder injection correction value FAF2) are used to correct the amount of injected fuel in the feedback control such that the air-fuel ratio of the engine 1 approaches the stoichiometric air-fuel ratio. The electronic controller 16 sets the passage injection correction value FAF1 and in-cylinder injection correction value FAF2 based on a feedback correction value FAF (hereinafter referred to as correction value FAF) which changes centered about [1.0] in accordance with the detection signal from the oxygen sensor 22. As mentioned above, the oxygen sensor 22 generates a signal (detection signal) corresponding to the oxygen concentration in the exhaust gas within the exhaust passage 15. That is, the detection signal from the oxygen sensor 22 represents the air-fuel ratio of the exhaust gas. When the air-fuel ratio represented by the detection signal from the oxygen sensor 22 is richer than the stoichiometric air-fuel ratio (fuel is rich), the electronic controller 16 increases the correction value FAF to reduce the amount of injected fuel. Conversely, the electronic controller 16 reduces the correction value FAF to increase the amount of injected fuel when the air-fuel ratio represented by the detection signal from the oxygen sensor 22 is leaner than the stoichiometric air-fuel ratio.

Figure 2:
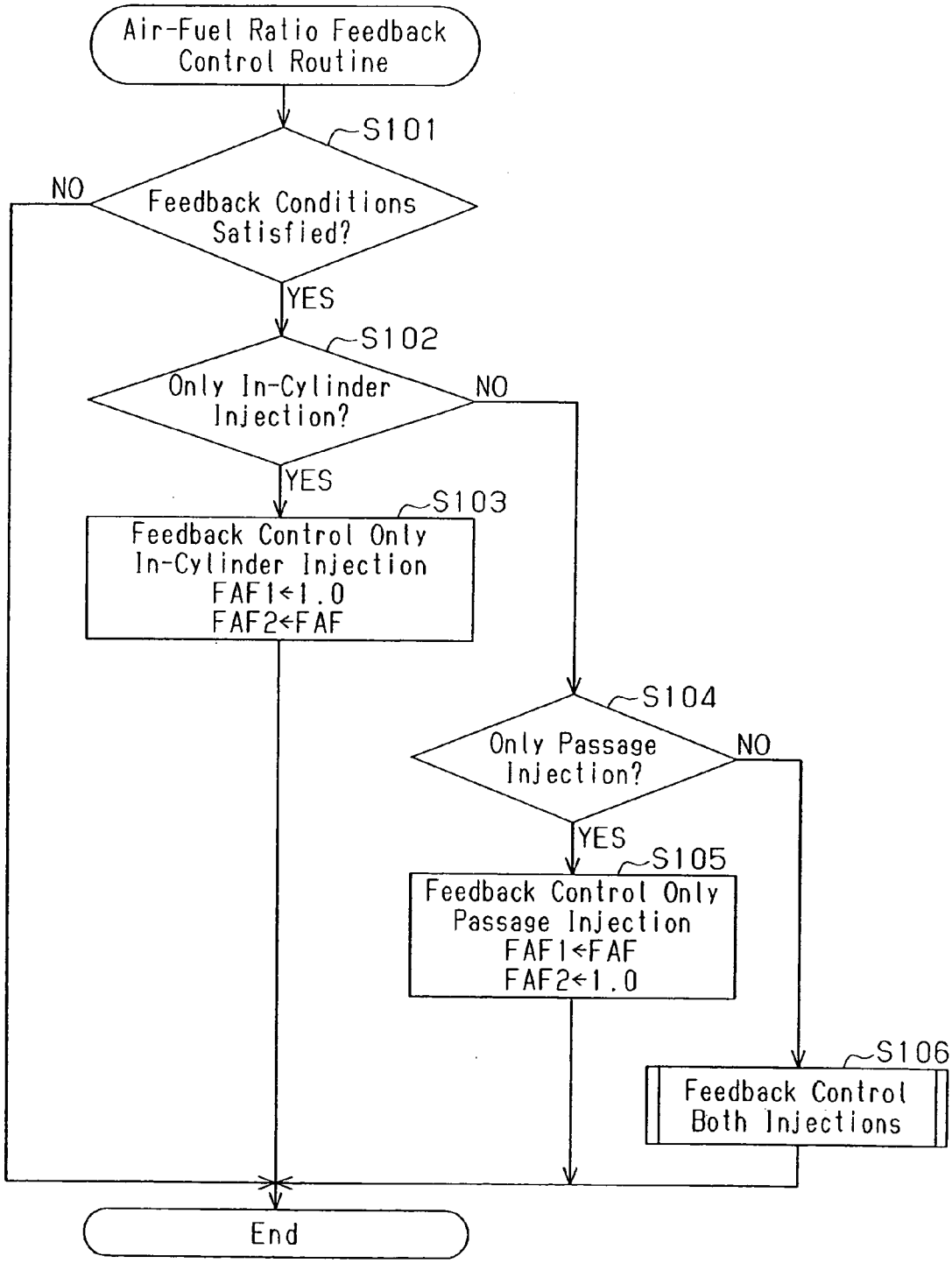
FIG. 2 is a flowchart showing the procedures for setting a passage injection feedback correction value and an in-cylinder injection feedback correction value.
Figure 3:
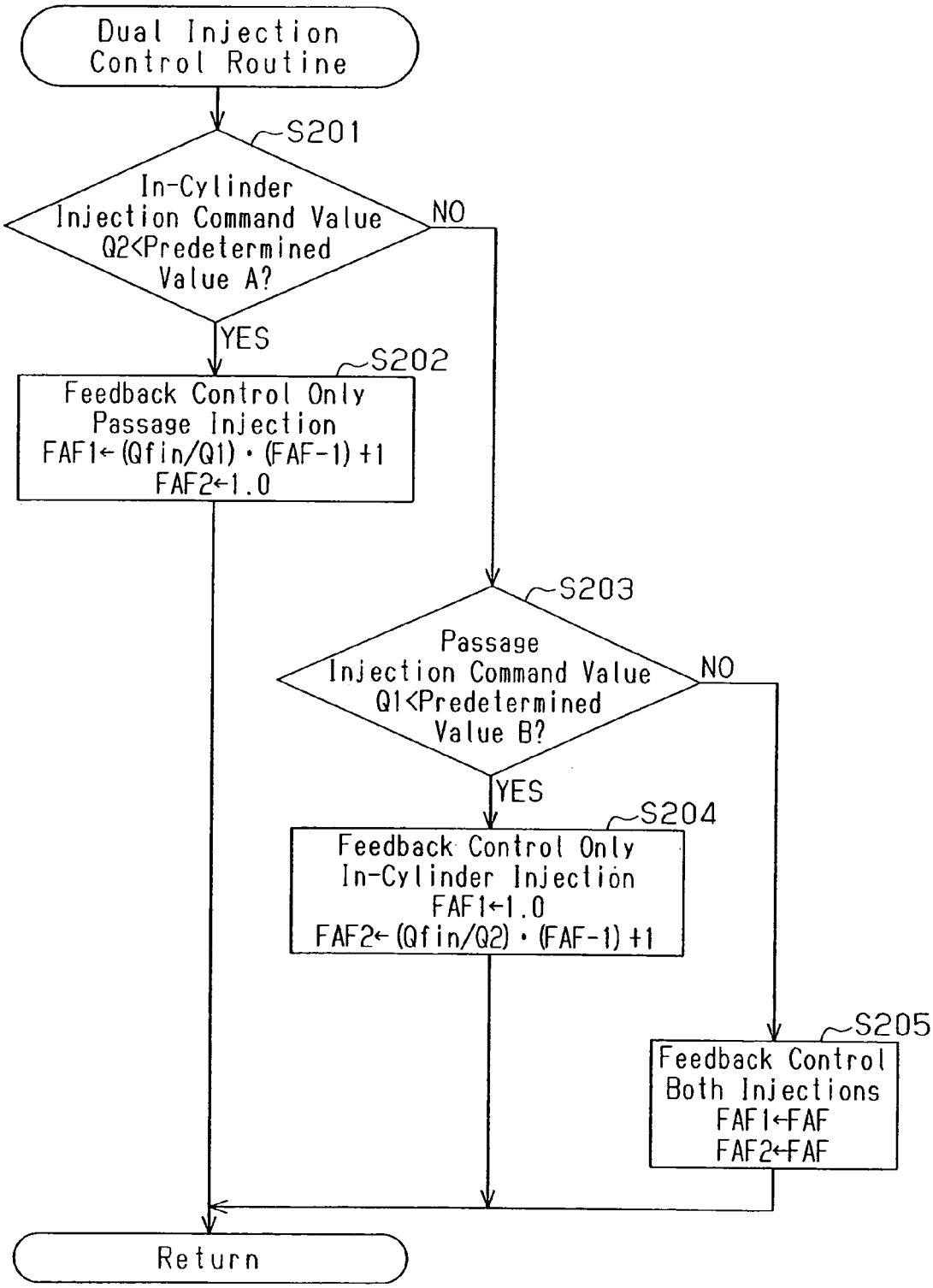
FIG. 3 is a flowchart showing the procedure for executing a process for preventing a passage injection command value from falling below an allowable lower limit and a process for preventing an in-cylinder injection command value from falling below an allowable lower limit.

The procedure for setting the passage injection correction value FAF1 and the in-cylinder injection correction value FAF2 is described below with reference to the flowchart of FIG. 2 which shows an air-fuel ratio feedback control routine. In the air-fuel ratio feedback control routine, the electronic controller 16 corrects the amount of injected fuel using the correction value FAF (FAF1 and FAF2) so as to have the air-fuel ratio of the engine 1 approach the stoichiometric air-fuel ratio. The electronic controller 16 executes the air-fuel ratio feedback control routine at predetermined crank angle interrupts.

First, the electronic controller 16 determines whether or not the conditions (feedback conditions) for enabling execution of the air-fuel ratio feedback control are satisfied (S101). Examples of feedback conditions include completion of engine warm up, activation of the oxygen sensor 22, the engine 1 not being in an excessively high speed and load state. The electronic controller 16 determines that the feedback conditions are satisfied when all of these conditions are satisfied. When the feedback conditions are satisfied and the determination is affirmative in step S101, the process advances to step S102 and the subsequent steps.

In the processing of step S102 and the subsequent steps, the electronic controller 16 executes the air-fuel ratio feedback control in accordance with whether (1) the in-cylinder injector 7 alone injects fuel, (2) the passage injector 6 alone injects fuel, or (3) the passage injector 6 and the in-cylinder injector 7 both inject fuel. The air-fuel ratio feedback control under the various conditions (1) through (3) is described below.

(1) When the in-cylinder injector 7 alone injects fuel (S102: YES)

In this case, the passage injector 6 does not inject fuel. Accordingly, the electronic controller 16 executes the feedback control only for fuel injection by the in-cylinder injector 7 (S103). The electronic controller 16 corrects the amount of injected fuel such that the air-fuel ratio of the engine 1 approaches the stoichiometric air-fuel ratio. Specifically, the electronic controller 16 uses [1.0] as the passage injection correction value FAF1 and the correction value FAF as the in-cylinder injection correction value FAF2. The air-fuel ratio of the engine 1 thus approaches the stoichiometric air-fuel ratio by correcting the amount of fuel injected by the in-cylinder injector 7 using the in-cylinder injection correction value FAF2.

(2) When the passage injector 6 alone injects fuel (S104: YES)

In this case, the in-cylinder injector 7 does not inject fuel. Accordingly, the electronic controller 16 executes the feedback control only for fuel injection by the passage injector 6 (S105). The electronic controller 16 corrects the amount of injected fuel such that the air-fuel ratio of the engine 1 approaches the stoichiometric air-fuel ratio. Specifically, the electronic controller 16 uses [1.0] as the in-cylinder injection correction value FAF2 and the correction value FAF as the passage injection correction value FAF1. The air-fuel ratio of the engine 1 thus approaches the stoichiometric air-fuel ratio by correcting the amount of fuel injected by the passage injector 6 using the passage injection correction value FAF1.

(3) When the passage injector 6 and in-cylinder injector 7 both inject fuel (S102: NO, S104: NO)

In this case, the passage injector 6 and the in-cylinder injector 7 both inject fuel. Accordingly, the electronic controller 16 executes the feedback control for fuel injection by both injector 6 and injector 7 (S106). The electronic controller 16 corrects the amount of injected fuel such that the air-fuel ratio of the engine 1 approaches the stoichiometric air-fuel ratio. Specifically, the electronic controller 16 uses the correction value FAF for both the passage injection correction value FAF1 and the in-cylinder injection correction value FAF2. The air-fuel ratio of the engine 1 thus approaches the stoichiometric air-fuel ratio by correcting the amount of fuel injected by the passage injector 6 using the passage injection correction value FAF1 and correcting the amount of fuel injected by the in-cylinder injector 7 using the in-cylinder injection correction value FAF2.

Under condition (3), fuel is allocated to and injected by the passage injector 6 and the in-cylinder injector 7 to obtain the total fuel injection amount Qfin. Accordingly, in this instance, the amount of fuel injected from each of the injectors 6 and 7 is small compared to when the total fuel injection amount Qfin is obtained by injecting fuel using only one of the injectors 6 and 7. Therefore, due to the correction of the fuel injection amount with the correction value FAF (FAF1, FAF2) an occasion may arise when the passage injection command value Q1 is less than the allowable lower limit min1, or the in-cylinder injection command value Q2 is less than the allowable lower limit min2. The allowable lower limit min1 is the minimum amount of fuel injected from the passage injector 6 that can be accurately controlled. The allowable lower limit min2 is the minimum amount of fuel injected from the in-cylinder injector 7 that can be accurately controlled.

Under condition (3), therefore, the electronic controller 16 executes a process for preventing the passage injection command value Q1 from falling below the allowable lower limit min1 and a process for preventing the in-cylinder injection command value Q2 from falling below the allowable lower limit min2. These processes are described below with reference to the flowchart of FIG. 3 which shows a dual injection control routine. The electronic controller 16 executes the dual injection control routine each time the process advances to step S106 (FIG. 2) of the air-fuel ratio feedback control routine.

First, the electronic controller 16 determines whether or not the in-cylinder injection command value Q2 is less than a predetermined value A (S201). When the in-cylinder injection command value Q2 is greater than the predetermined value A, the electronic controller 16 determines whether or not the passage injection command value Q1 is less than a predetermined value B (S203). The predetermined value A is set to a value suitable for determining whether or not there is a possibility that the command value Q2 has been reduced to less than the allowable lower limit min2 by the correction of the in-cylinder injection command value Q2 using the in-cylinder injection correction value FAF2. The predetermined value A may be set, for example, to a value greater than the allowable lower limit min2 by a predetermined amount. The predetermined value B is set to a value suitable for determining whether or not there is a possibility that the command value Q1 has been reduced to less than the allowable lower limit min1 by the correction of the passage injection command value Q1 using the passage injection correction value FAF1. The predetermined value B may be set, for example, to a value greater than the allowable lower limit min1 by a predetermined amount.

When the determinations of both steps S201 and S203 are negative, the electronic controller 16 determines there is no concern with the amount of injected fuel being reduced to below the allowable lower limit in either of the in-cylinder injector 7 and passage injector 6 and thus proceeds to step S205. In the process of step S205, the electronic controller 16 corrects the amount of injected fuel of both the passage injector 6 and the in-cylinder injector 7 as described in condition (3) above. At this time, the electronic controller 16 uses the correction value FAF for both the passage injection correction value FAF1 and the in-cylinder injection correction value FAF2.

Figures 4A, 4B, 4C, 4D:
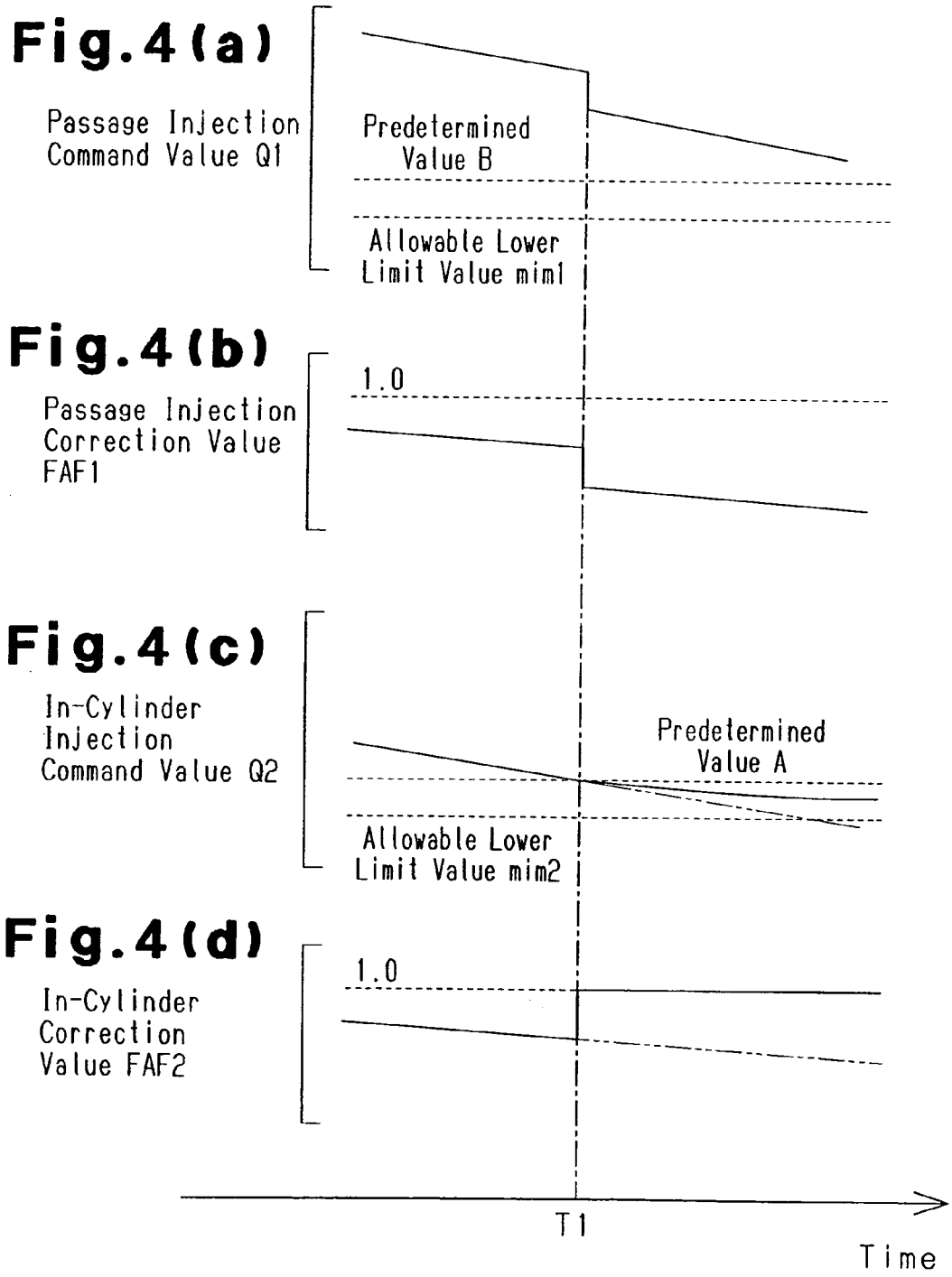
FIGS. 4(*a*) through 4(*d*) are timing charts showing the transition of the passage injection command value, a passage injection feedback correction value, an in-cylinder injection command value, and an in-cylinder injection feedback correction value when the process for preventing the in-cylinder injection command value from falling below the allowable lower limit value is executed.

When the determination in step S201 is affirmative, the electronic controller 16 determines there is concern with the in-cylinder command value Q2 being reduced to below the allowable lower limit min2 by the correction using the in-cylinder injection correction value FAF2. The electronic controller 16 thus executes the process of step S202 to prevent the in-cylinder injection command value Q2 from falling below the allowable lower limit min2. The process of step S202 is described below with reference to the timing charts of FIGS. 4(*a*) through 4(*d*). FIGS. 4(*a*) through 4(*d*) show the transitions of the passage injection command value Q1, passage injection correction value FAF1, in-cylinder injection command value Q2, and in-cylinder injection correction value FAF2.

When the air-fuel ratio of the engine 1 is richer than the stoichiometric air-fuel ratio, both the passage injection correction value FAF1 and the in-cylinder injection correction value FAF2 are reduced from [1.0]. In conjunction with this reduction, the passage injection command value Q1 and the in-cylinder injection command value Q2 are also reduced. Thereafter, for example, the in-cylinder injection command value Q2 is reduced to below the predetermined value A, as shown in FIG. 4(*c*). Then, the electronic controller 16 sets (fixes) the in-cylinder injection correction value FAF2 to [1.0], as indicated by the solid line in FIG. 4(*d*), and stops the correction of the in-cylinder injection command value Q2 using the correction value FAF2.

For example, assume the in-cylinder injection correction value FAF2 is not fixed and continues to decrease as indicated by the dashed line in FIG. 4(*d*), and the in-cylinder injection command value Q2 is reduced to less than the allowable lower limit min2, as indicated by the dashed line in FIG. 4(*c*). When the electronic controller 16 controls the in-cylinder injector 7 based on the command value Q2 that has become less than the allowable limit min2, the amount of fuel injected by the injector 7 deviates greatly from the suitable amount and the fuel injection amount cannot be accurately controlled.

However, the electronic controller 16 of the first embodiment stops the correction of the in-cylinder injection command value Q2 using the in-cylinder injection correction value FAF2 as described above when the in-cylinder injection command value Q2 falls below the predetermined value A. Accordingly, the in-cylinder injection command value Q2 transitions as indicated by the solid line in FIG. 4(*c*), thus preventing the command value Q2 from falling below the allowable lower limit min2. Accordingly, the electronic controller 16 is capable of controlling the amount of fuel injected by the injector 7 with high accuracy.

When the in-cylinder injection correction value FAF2 is fixed at [1.0], the electronic controller 16 is capable of having the air-fuel ratio of the engine 1 approach the stoichiometric air-fuel ratio by correcting the passage injection command value Q1 using the passage injection correction value FAF1. However, there is a delay in the convergence of the air-fuel ratio of the engine 1 to the stoichiometric air-fuel ratio, and this delay is caused by the in-cylinder injection correction value FAF2 being fixed at [1.0]. Taking this situation into consideration, the electronic controller 16 sets the passage injection correction value FAF1 so as to compensate for the effect that fixing the in-cylinder injection correction value FAF2 at [1.0] has on the entire amount of fuel injected into the engine.

The passage injection correction value FAF1 may be set based on, for example, equation (4) below.

$$FAF1=(Qfin/Q1)\cdot(FAF-1)+1 \quad (4)$$

In the equation, FAF1 represents the passage injection correction value, Qfin represents the total fuel injection amount, Q1 represents the passage injection command value, and FAF represents the correction value.

In equation (4), the term [FAF−1] represents the amount of change in FAF from the FAF reference value of [1.0]. That is, the term [FAF−1] corresponds to the amount of change from the amount of injected fuel necessary to have the air-fuel ratio of the engine 1 approach the stoichiometric air-fuel ratio when both the passage injector 6 and the in-cylinder injector 7 inject fuel. The term [Qfin/Q1] is the ratio of the total fuel injection amount Qfin relative to the passage injection command value Q1. That is, the term [Qfin/Q1] represents the rate of change in [FAF-1] necessary to realize a change in the amount of injected fuel equal to the fuel injected by both injectors 6 and 7 with a change in the amount of the fuel injected by the passage injector 6 alone. In this way, the electronic controller 16 sets the passage injection correction value FAF1 in accordance with the equation (4) so as to compensate for the effect on the amount of injected fuel of the entire engine by having the in-cylinder injection correction value FAF2 fixed at [1.0].

As a result, the passage injection correction value FAF1 is greatly reduced (time T1) such that the air-fuel ratio approaches the stoichiometric air-fuel ratio, as shown in FIG. 4(*b*). In conjunction with the reduction of the correction value FAF1, the passage injection command value Q1 is greatly reduced (corrected) as indicated in FIG. 4(*a*). This prevents the convergence of the air-fuel ratio of the engine 1 to the stoichiometric air-fuel ratio from being delayed when the correction of the in-cylinder injection command value Q2 using the in-cylinder injection correction value FAF2 is stopped (that is, when the in-cylinder injection correction value FAF2 is fixed at [1.0]).

Figures 5A, 5B, 5C, 5D:
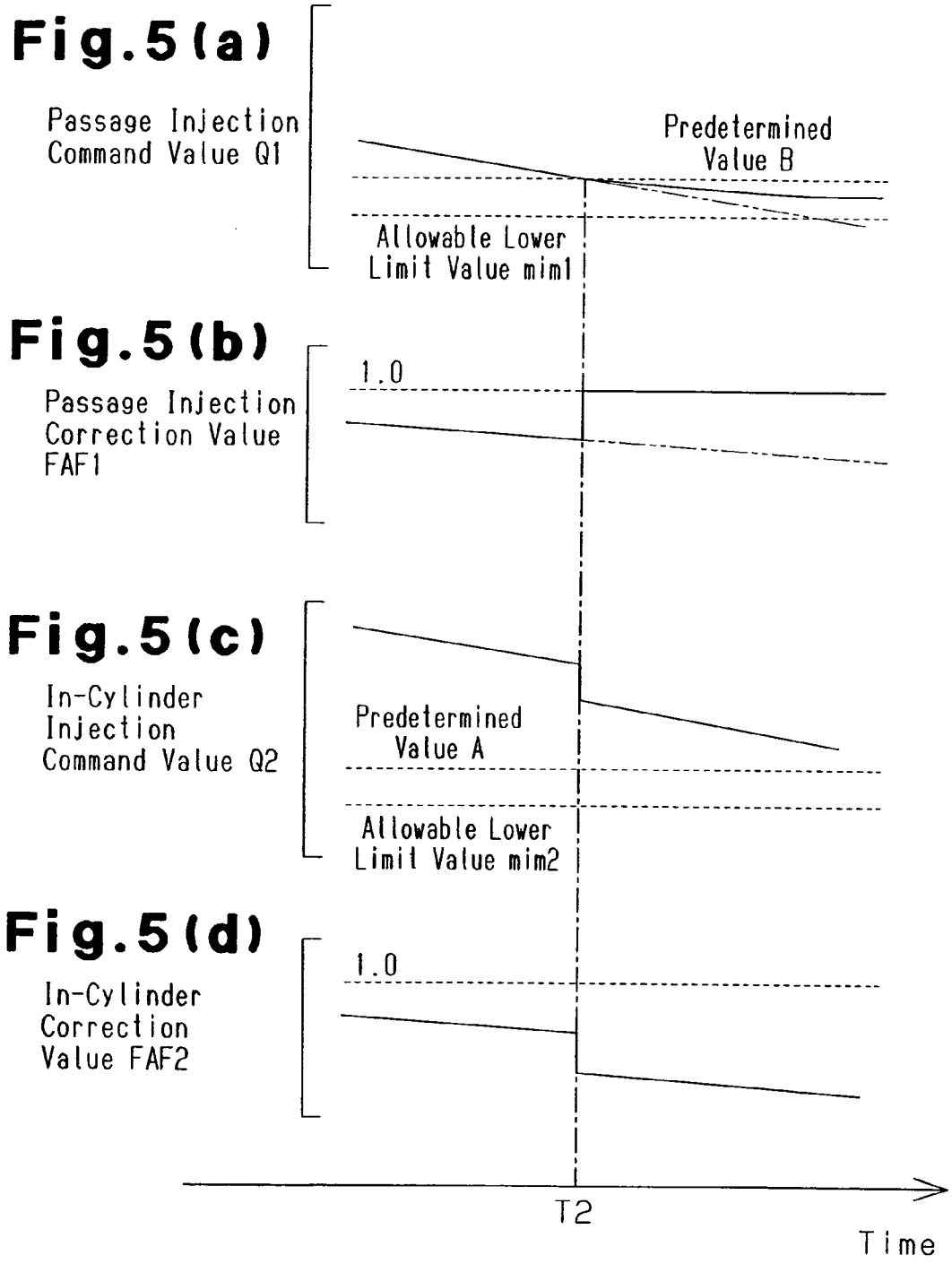
FIGS. 5(*a*) through 5(*d*) are timing charts showing the transition of the passage injection command value, a passage injection feedback correction value, an in-cylinder injection command value, and an in-cylinder injection feedback correction value when the process for preventing the passage injection command value from falling below the allowable lower limit value is executed.

When the determination of the dual injection control routine of step S203 (FIG. 3) is affirmative, the electronic controller 16 determines that there is concern with the passage injection command value Q1 being reduced to below the allowable lower limit min1 by the correction using the passage injection correction value FAF1. The electronic controller 16 executes the process of step S204 to prevent the passage injection command value Q1 from falling below the allowable lower limit min1. The process of step S204 is described below with reference to the timing chart of FIG. 5. FIGS. 5(*a*) through 5(*d*) show the transitions of the passage injection command value Q1, passage injection correction value FAF1, in-cylinder injection command value Q2, and in-cylinder injection correction value FAF2.

When the air-fuel ratio of the engine 1 is richer than the stoichiometric air-fuel ratio, both the passage injection correction value FAF1 and the in-cylinder injection correction value FAF2 are reduced from [1.0]. In conjunction with this reduction, the passage injection command value Q1 and the in-cylinder injection command value Q2 are also reduced. Thereafter, for example, the passage injection command value Q1 is reduced below the predetermined value B, as shown in FIG. 5(*a*). Then, the electronic controller 16 sets the passage injection correction value FAF1 to [1.0], as indicated by the solid line in FIG. 5(*b*), and stops the correction of the passage injection command value Q1 using the correction value FAF1.

For example, assume the passage injection correction value FAF1 is not fixed and continues to decrease as indicated by the dashed line in FIG. 5(*b*), and the passage injection command value Q1 is reduced to less than the allowable lower limit min1, as shown by the dashed line in FIG. 5(*a*). When the electronic controller 16 controls the passage injector 6 based on the command value Q1 that has become less than the allowable limit min1, the amount of fuel injected by the injector 6 deviates greatly from the suitable amount and the fuel injection amount cannot be accurately controlled.

However, the electronic controller 16 of the first embodiment stops the correction of the passage injection command value Q1 using the passage injection correction value FAF1 as described above when the passage injection command value Q1 falls below a predetermined value B. Accordingly, the passage injection command value Q1 transitions as indicated by the solid line in FIG. 5(*a*), thus preventing the command value Q1 from falling below the allowable lower limit min1. Therefore, the electronic controller 16 is capable of controlling the amount of fuel injected by the injector 6 with high accuracy.

When the passage injection correction value FAF1 is fixed at [1.0], the electronic controller 16 is capable of having the air-fuel ratio of the engine 1 approach the stoichiometric air-fuel ratio by correcting the in-cylinder injection command value Q2 using the in-cylinder injection correction value FAF2. However, there is a delay in the convergence of the air-fuel ratio of the engine 1 to the stoichiometric air-fuel ratio, and this delay is caused by the passage injection correction value FAF1 being fixed at [1.0]. Taking this situation into consideration, the electronic controller 16 sets the in-cylinder injection correction value FAF2 so as to compensate for the effect that fixing the passage injection correction value FAF1 at [1.0] has on the entire amount of fuel injected in the engine.

The in-cylinder injection correction value FAF2 may be set based on, for example, equation (5) below.

$$FAF2=(Qfin/Q2)\cdot(FAF-1)+1 \quad (5)$$

In the equation, FAF2 represents the in-cylinder injection correction value, Qfin represents the total fuel injection amount, Q1 represents the passage injection command value, and FAF represents the correction value.

In equation (5), the term [FAF−1] represents the amount of change in FAF from the FAF reference value of [1.0]. That is, the term [FAF−1] corresponds to the amount of change from the amount of injected fuel necessary to have the air-fuel ratio of the engine 1 approach the stoichiometric air-fuel ratio when both the passage injector 6 and the in-cylinder injector 7 inject fuel. The term [Qfin/Q2] is the ratio of the total fuel injection amount Qfin relative to the in-cylinder injection command value Q2. That is, the term [Qfin/Q2] represents the rate of change in [FAF−1] necessary to realize a change in the amount of injected fuel equal-to the fuel injected by both injectors 6 and 7 with a change in the amount of the fuel injected by the in-cylinder injector 7 alone. In this way, the electronic controller 16 sets the in-cylinder injection correction value FAF2 so as to compensate for the effect on the amount of injected fuel of the entire engine by having the passage injection correction value FAF1 fixed at [1.0].

As a result, the in-cylinder injection correction value FAF2 is greatly reduced (time T2) such that the air-fuel ratio approaches the stoichiometric air-fuel ratio, as shown in FIG. 5(*d*). In conjunction with the reduction of the correction value FAF2, the in-cylinder injection command value Q2 is greatly reduced (corrected) as indicated in FIG. 5(*c*). This prevents the convergence of the air-fuel ratio of the engine 1 to the stoichiometric air-fuel ratio form being delayed when the correction of the passage injection command value Q1 using the passage injection correction value FAF1 is stopped (that is, when the passage injection correction value FAF1 is fixed at [1.0]).

The electronic controller 16 of the first embodiment has the advantages described below.

(1) Under condition (3), the electronic controller 16 corrects the amount of injected fuel using the correction value FAF (FAF1, FAF2). When the passage injection command value Q1 is reduced to below the predetermined value B, the electronic controller 16 sets (fixes) the passage injection correction value FAF1, which corrects the command value Q1, to [1.0]. As a result, the correction that reduces the passage injection command value Q1 is stopped. Accordingly, the electronic controller 16 prevents the passage injection command value Q1 from falling below the allowable lower limit min1 and accurately controls the amount of fuel injected by the passage injector 6. Furthermore, under condition (3), when the in-cylinder injection command value Q2 is reduced below the predetermined value A, the electronic controller 16 sets (fixes) the in-cylinder injection correction value FAF2, which corrects the command value Q2, to [1.0]. As a result, the correction that reduces the in-cylinder injection command value Q2 is stopped. Accordingly, the electronic controller 16 prevents the in-cylinder injection command value Q2 from falling below the allowable lower limit min2 and accurately controls the amount of fuel injected by the in-cylinder injector 7.

(2) When the passage injection command value Q1 becomes less than the predetermined value B, the electronic controller 16 stops the correction that reduces the passage injection command value Q1. At this time, the electronic controller 16 sets the in-cylinder injection correction value FAF2 based on equation (5). The correction value FAF2 is set so as to compensate for the effect that not performing the correction that reduces the passage injection command value Q1 has on the amount of injected fuel of the entire engine. The electronic controller 16 corrects the in-cylinder injection command value Q2 using the in-cylinder injection correction value FAF2. In this way, the electronic controller 16 suppresses the delayed convergence of the air-fuel ratio of the engine 1 to the stoichiometric air-fuel ratio which is caused by stopping the correction of the passage injection command value Q1. When the in-cylinder injection command value Q2 becomes less than the predetermined value A, the electronic controller 16 stops the correction that reduces the in-cylinder injection command value Q2. At this time, the electronic controller 16 sets the passage injection correction value FAF1 based on equation (4). The correction value FAF1 is set so as to compensate for the effect that not performing the correction which reduces the in-cylinder injection command value Q2 has on the amount of injected fuel of the entire engine. The electronic controller 16 corrects the passage injection command value Q1 using the passage injection correction value FAF1. In this way, the electronic controller 16 suppresses the delayed convergence of the air-fuel ratio of the engine 1 to the stoichiometric air-fuel ratio that is caused by stopping the correction of the in-cylinder injection command value Q2.

Second Embodiment

Figure 6:
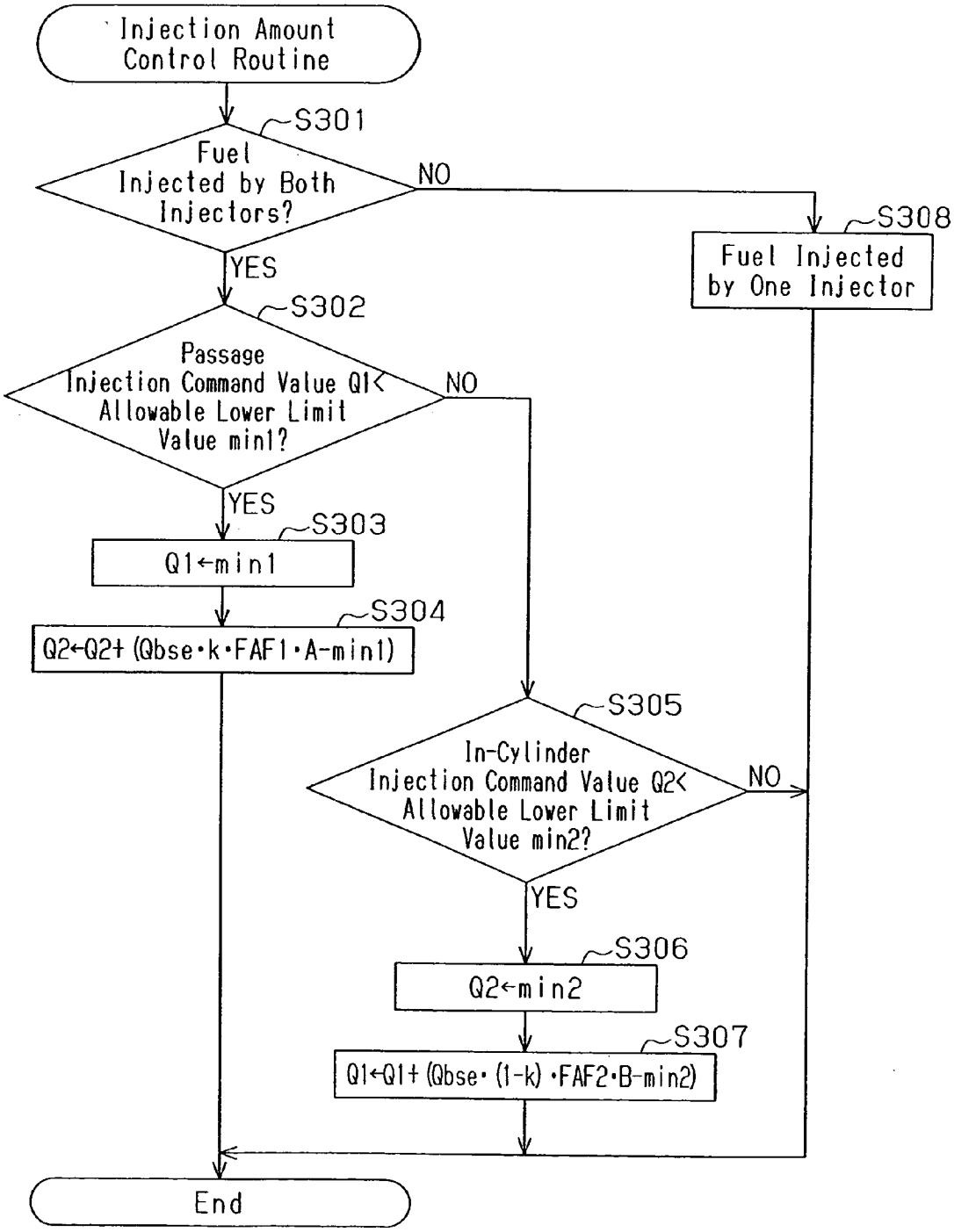
FIG. 6 is a flowchart showing the procedure for executing a process for preventing the passage injection command value from falling below the allowable lower limit value and a process for preventing the in-cylinder injection command value from falling below the allowable lower limit value according to a second embodiment of the present invention.

An electronic controller 16 according to a second embodiment of the present invention will now be discussed with reference to FIGS. 6 through 8.

In the second embodiment, under condition (3) of the first embodiment (when fuel is injected by both the passage injector 6 and in-cylinder injector 7), the electronic controller 16 always uses the correction value FAF for the passage injection correction value FAF1 and the in-cylinder injection correction value FAF2. The electronic controller 16 executes processes which differ from those of the first embodiment to prevent the passage injection command value Q1 from falling below the allowable lower limit min1, and prevents the in-cylinder injection command value Q2 from falling below the allowable lower limit min2. These processes are described below with reference to the flowchart of FIG. 6, which shows an injection amount control routine. The electronic controller 16 executes the injection amount control routine in angular interrupts of predetermined crank angles.

In the injection amount control routine, first, the electronic controller 16 determines whether or not fuel is injected by both the passage injector 6 and the in-cylinder injector 7 (step S301). If the determination is negative in step S301, fuel is injected by only one of the passage injector 6 and the in-cylinder injector 7 (S308). When the determination is affirmative in step S301, the electronic controller 16 advances to the processes of steps S302 through S307. The processes of step S302 through S304 prevent the passage injection command value Q1 from falling below the allowable lower limit min1. The processes of steps S305 through S307 prevent the in-cylinder injection command value Q2 from falling below the allowable lower limit min2.

The processes of steps S302 through S304 are described below with reference to the timing charts of FIGS. 7(*a*) through 7(*d*). FIGS. 7(*a*) through 7(*d*) show the transitions of the passage injection command value Q1, the passage injection correction value FAF1, the in-cylinder injection command value Q2, and the in-cylinder injection correction value FAF2.

Figures 7A, 7B, 7C, 7D:
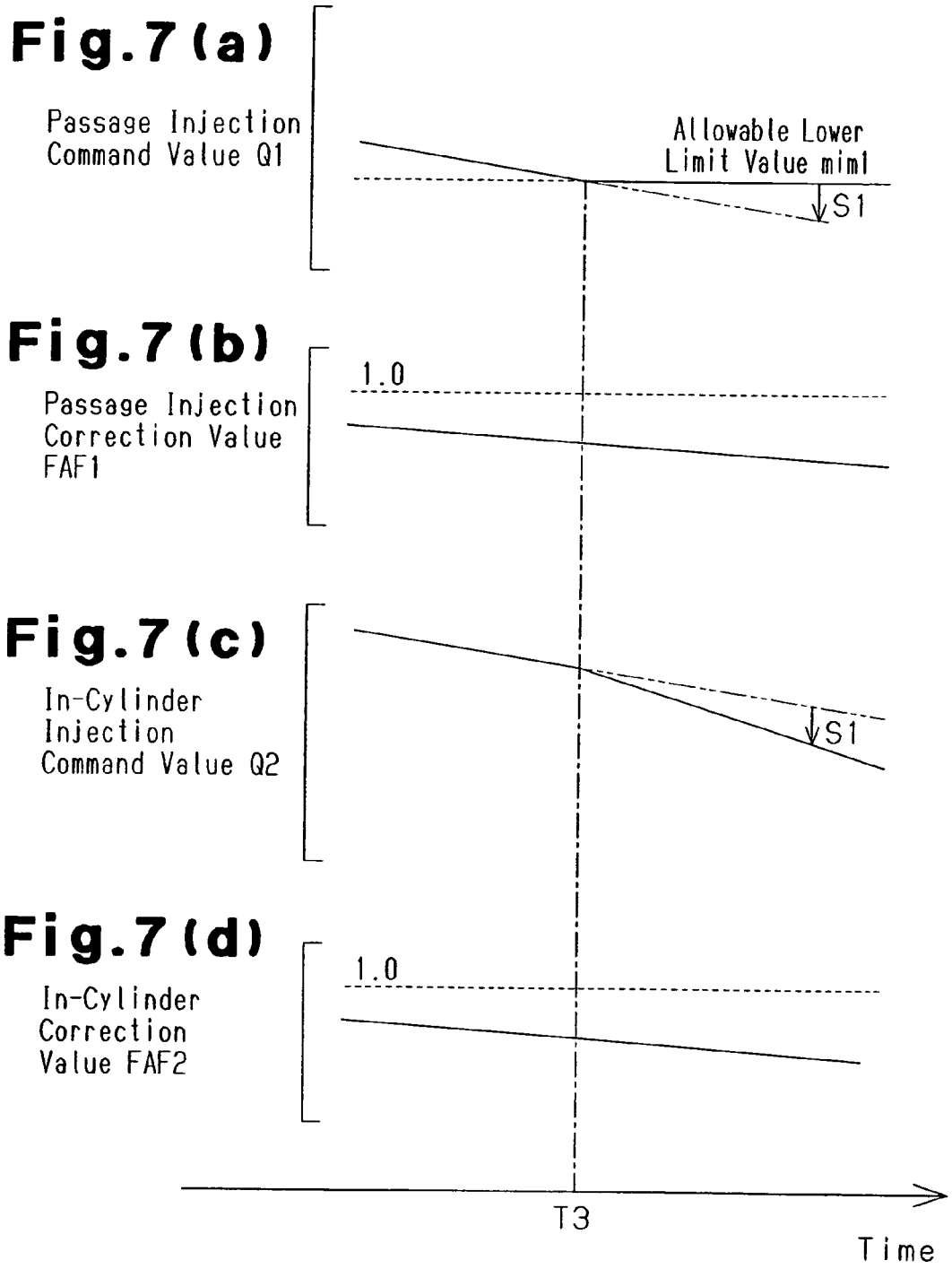
FIGS. 7(*a*) through 7(*d*) are timing charts showing the transition of the passage injection command value, the passage injection feedback correction value, the in-cylinder injection command value, and the in-cylinder injection feedback correction value when the process for preventing the passage injection command value from falling below the allowable lower limit value is executed.

When the air-fuel ratio of the engine 1 is richer than the stoichiometric air-fuel ratio, the passage injection correction value FAF1 and the in-cylinder injection correction value FAF2 are reduced from [1.0], as shown in FIGS. 7(*b*) and 7(*d*). In conjunction with this reduction, the passage injection command value Q1 and the in-cylinder injection command value Q2 are also reduced. Thereafter, for example, the passage injection command value Q1 is reduced below the allowable lower limit min1 at time T3, as indicated in FIG. 7(*a*) (step S302: YES). Then, the electronic controller 16 fixes the command value Q1 at the allowable lower limit min1, as indicated by the solid line (S303), thus preventing the command value Q1 from falling below the allowable lower limit min1.

When the passage injection command value Q1 is thus forcibly fixed at the allowable lower limit value min1, the amount of fuel injected by the passage injector 6 is more than the optimum amount. Accordingly, excess fuel is injected into the entire engine 1, and it becomes difficult to have the air-fuel ratio of the engine 1 approach the stoichiometric air-fuel ratio. As a result, there is delayed convergence of the air-fuel ratio to the stoichiometric air-fuel ratio or the air-fuel ratio remains in the rich state and does not change to the lean state. In consideration of this situation, the electronic controller 16 reduces the in-cylinder injection command value Q2 so as to offset the excess fuel injection which occurs in conjunction with the fixing of the passage injection command value Q1 at the allowable lower limit min1 (S304). The in-cylinder injection command value Q2 may be reduced based on, for example, equation (6).

$$Q2 \rightarrow Q2 + (Qbse \cdot k \cdot FAF1 \cdot A - \min 1) \quad (6)$$

In the equation, Q2 represents the in-cylinder injection command value, Qbse represents the basic amount of injected fuel, FAF1 represents the passage injection correction value, k represents an allocation coefficient, A represents another correction coefficient, and min1 represents the allowable lower limit of the passage injection command value.

In equation (6), the term [Qbse·k·FAF1·A] is the passage injection command value Q1 when Q1 is not fixed at the allowable lower limit min1. Accordingly, the term [Qbse·k·FAF1·A−min1] is a negative value and represents the difference S1 (refer to FIG. 7(*a*)) between the passage injection command value Q1 when Q1 is fixed at the lower limit min1 and the passage injection command value Q1 when Q1 is not fixed. The in-cylinder injection command value Q2 is reduced by the difference S1, that is, by the term (Qbse·k·FAF1·A−min1). The electronic controller 16 reduces the in-cylinder injection command value Q2 in this manner to offset the excess amount of injected fuel of the overall engine occurring in conjunction with the fixing of the passage injection command value Q1 at the allowable lower limit min1. In this way, the electronic controller 16 prevents the convergence of the air-fuel ratio of the engine one to the stoichiometric air-fuel ratio from being delayed and enables the air-fuel ratio to change from a rich state to a lean state.

The processes of steps S305 through S307 are described below with reference to the timing chart of FIGS. 8(*a*) through 8(*d*). FIGS. 8(*a*) through 8(*d*) show the transitions of the passage injection command value Q1, the passage injection correction value FAF1, the in-cylinder injection command value Q2, and the in-cylinder injection correction value FAF2.

Figures 8A, 8B, 8C, 8D:
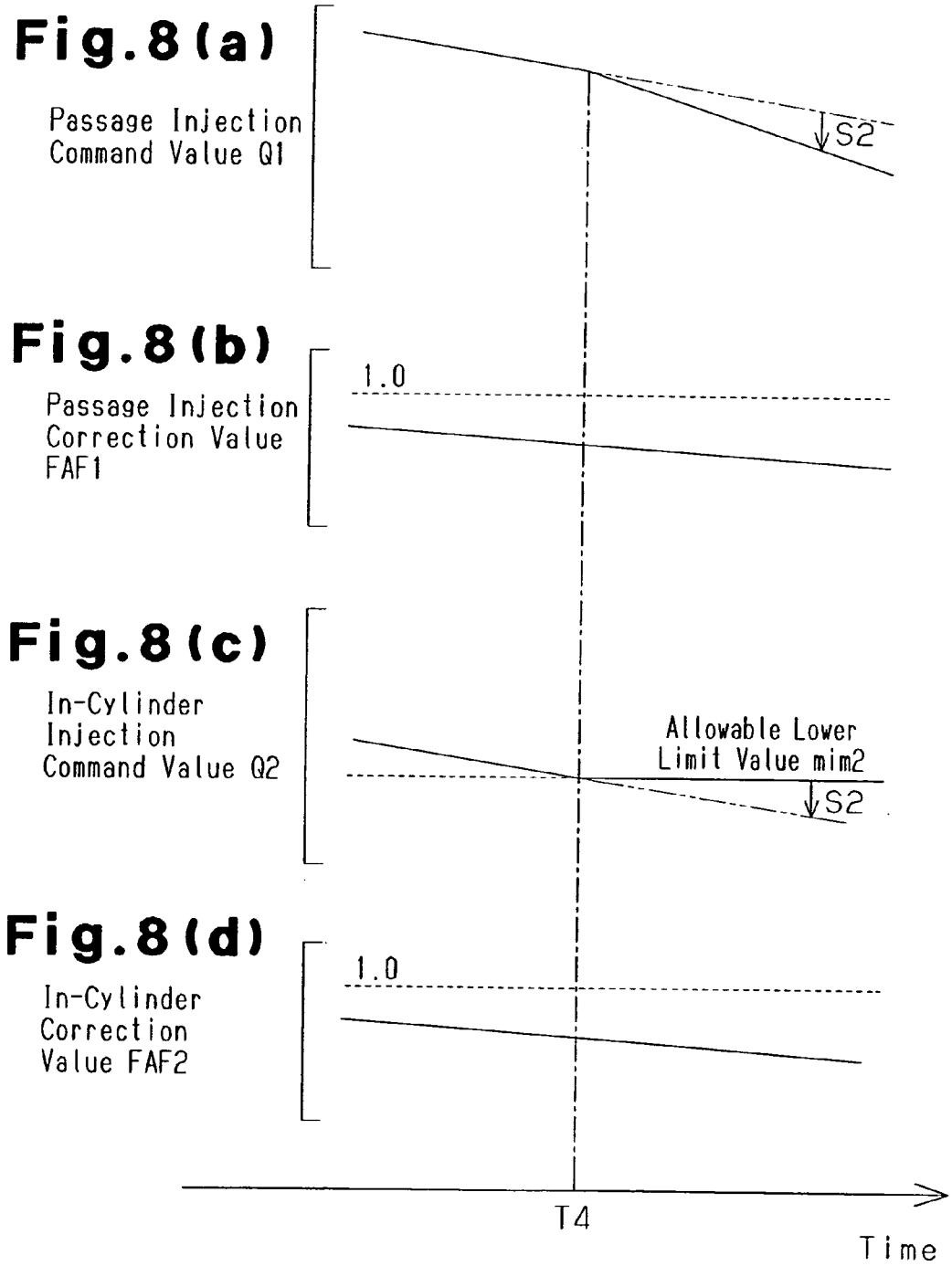
FIGS. 8(*a*) through 8(*d*) are timing charts showing the transition of the passage injection command value, the passage injection feedback correction value, the in-cylinder injection command value, and the in-cylinder injection feedback correction value when the process for preventing the in-cylinder injection command value from falling below the allowable lower limit value is executed.

When the air-fuel ratio of the engine 1 is richer than the stoichiometric air-fuel ratio, the passage injection correction value FAF1 and the in-cylinder injection correction value FAF2 are reduced from [1.0], as shown in FIGS. 8(*b*) and 8(*d*). In conjunction with this reduction, the passage injection command value Q1 and the in-cylinder injection command value Q2 are also reduced. Thereafter, for example, the in-cylinder injection command value Q2 is reduced to below the allowable lower limit min2 at time T4, as shown in FIG. 8(*c*) (S305: YES). Then, the electronic controller 16 fixes the command value Q2 at the allowable lower limit min2, as indicated by the solid line (S306), thus preventing the reduction of the command value Q2 from falling below the allowable lower limit min2.

When the in-cylinder injection command value Q2 is thus forcibly fixed at the allowable lower limit min2, the amount of fuel injected by the in-cylinder injector 7 is more than an optimum amount. Accordingly, excess fuel is injected in the entire engine 1, and it becomes difficult to have the air-fuel ratio of the engine 1 approach the stoichiometric air-fuel ratio. As a result, there is delayed convergence of the air-fuel ratio to the stoichiometric air-fuel ratio, or the air-fuel ratio remains in the rich state and does not change to the lean state. In consideration of this situation, the electronic controller 16 reduces the passage injection command value Q1 so as to offset the excess fuel injection which occurs in conjunction with the fixing of the in-cylinder injection command value Q2 at the allowable lower limit min2 (S307). The passage injection command value Q1 may be reduced based on, for example, equation (7).

$$Q2 \rightarrow Q1 + (Qbse \cdot (1-k) \cdot FAF2 \cdot B - \min 2) \quad (7)$$

In the equation, Q1 represents the passage injection command value, Qbse represents the basic amount of injected fuel, FAF2 represents the in-cylinder injection correction value, k represents an allocation coefficient, B represents another correction coefficient, and min2 represents the allowable lower limit of the in-cylinder injection command value.

In equation (7), the term [Qbse·(1−k)·FAF2·B] is the in-cylinder injection command value Q2 when Q2 is not fixed at the allowable lower limit min2. Accordingly, the term [Qbse·(1−k)·FAF2·B−min2] is a negative value, and represents the difference S1 (refer to FIG. 8) between the in-cylinder injection command value Q2 when Q2 is fixed at the lower limit min2 and the in-cylinder injection command value Q2 when Q2 is not fixed. The passage injection command value Q1 is reduced by the difference S1, that is, by the term (Qbse·(1−k)·FAF2·B−min2). The electronic controller 16 reduces the passage injection command value Q1 in this manner to offset the excess amount of injected fuel of the entire engine occurring in conjunction with the fixing of the in-cylinder injection command value Q2 at the allowable lower limit min2. In this way, the electronic controller 16 prevents the convergence of the air-fuel ratio of the engine 1 to the stoichiometric air-fuel ratio from being delayed and enables the air-fuel ratio to change from a rich state to a lean state.

The electronic controller 16 of the second embodiment has the advantages described below.

(3) Under condition (3), the electronic controller 16 corrects the amount of injected fuel using the correction value FAF (FAF1, FAF2). When the passage injection command value Q1 is reduced to below the allowable lower limit min1, the electronic controller 16 fixes the command value Q1 at the allowable lower limit value min1. Accordingly, the electronic controller 16 prevents the passage injection command value Q1 from falling below the allowable lower limit value min1 and accurately controls the amount of fuel injected by the passage injector 6. Furthermore, under condition (3), when the in-cylinder injection command value Q2 is reduced to a predetermined value A, the electronic controller 16 fixes the command value Q2 at the allowable lower limit min2. Accordingly, the electronic controller 16 prevents the in-cylinder injection command value Q2 from falling below the allowable lower limit min2 and accurately controls the amount of fuel injected by the in-cylinder injector 7.

(4) When the passage injection command value Q1 is fixed at the allowable lower limit min1, the passage injection command value Q2 is larger than the optimum value. In this case, excess fuel is injected, and it becomes difficult to have the air-fuel ratio of the engine 1 approach the stoichiometric air-fuel ratio. As a result, there is delayed convergence of the air-fuel ratio to the stoichiometric air-fuel ratio, or the air-fuel ratio remains in the rich state and does not change to the lean state. The electronic controller 16 of the second embodiment, however, reduces the in-cylinder injection command value Q2 based on equation (6) so as to offset the amount of excess fuel injected pursuant to the passage injection command value Q1. Accordingly, the electronic controller 16 prevents the previously described problems. When the in-cylinder injection command value Q2 is fixed at the allowable lower limit min2, the in-cylinder injection command value Q2 is larger than the optimum value. In this case, excess fuel is injected, and it is difficult to have the air-fuel ratio of the engine 1 approach the stoichiometric air-fuel ratio. As a result, there is delayed convergence of the air-fuel ratio to the stoichiometric air-fuel ratio, or the air-fuel ratio remains in the rich state and does not change to the lean state. The electronic controller 16 of the second embodiment, however, reduces the passage injection command value Q1 based on equation (7) so as to offset the amount of excess fuel injected pursuant to the in-cylinder injection command value Q2. Accordingly, the electronic controller 16 prevents the previously described problems.

Other Embodiments

It should be apparent to those skilled in the art that the present invention may be embodied in many other specific forms without departing from the spirit or scope of the invention. Particularly, it should be understood that the present invention may be embodied in the following forms.

In the first embodiment, when the in-cylinder injection correction value FAF2 is fixed at [1.0], the electronic controller 16 sets the passage injection correction value FAF1 so as to compensate for the effect that correcting the in-cylinder injection command value Q2 has on the amount of fuel injected in the entire engine. However, the present invention is not limited to this arrangement. For example, the electronic controller 16 also may subtract a fixed value from the passage injection correction value FAF1 in order to reduce the aforesaid effect. In this case, when the passage injection correction value FAF1 is fixed at [1.0], the electronic controller 16 may also subtract a fixed value from the in-cylinder injection correction value FAF2.

In the second embodiment, when the electronic controller 16 fixes the passage injection command value Q1 at the allowable lower limit min1, the in-cylinder injection command value Q2 is reduced so as to offset the excess amount of fuel injected pursuant to the passage injection command value Q1, however, the present invention is not limited to this arrangement. For example, the electronic controller 16 may also subtract a fixed value from the in-cylinder injection command value Q2 so as to prevent the amount of injected fuel from being excessive. In this case, when the electronic controller 16 fixes the in-cylinder injection command value Q2 at the allowable lower limit min2, a fixed value may also be subtracted from the passage injection command value Q1.

In the first and second embodiments, the passage injector 6 injects fuel into an intake port 2*a*. Alternatively, an injector for injecting fuel into the intake passage 2 upstream from the intake port 2*a* may be used in the engine 1.

Furthermore, the first and second embodiments may be combined.

The present examples and embodiments are to be considered as illustrative and not restrictive, and the invention is not to be limited to the details given herein, but may be modified within the scope and equivalence of the appended claims.

What is claimed is:

1. A controller for controlling fuel injection in an engine, the engine including an intake passage, a combustion chamber, a passage injector for injecting fuel into the intake passage, and an in-cylinder injector for injecting fuel into the combustion chamber, the controller comprising:

a control means for controlling the passage injector and the in-cylinder injector so that the passage injector and the in-cylinder injector allocate and inject fuel; and a correction means for correcting the fuel injection amount for the engine with a correction value that is based on an air-fuel ratio in the engine, the correction means correcting a fuel injection amount of only one of the injectors among the passage injector and the in-cylinder injector with the correction value when the fuel injection amount of the other one of the injectors among the passage injector and the in-cylinder injector is less than or equal to a value that indicates the possibility of the fuel injection amount falling below an allowable lower limit value due to correction with the correction value.

2. The controller according to claim 1, wherein:

the correction value is one of a plurality of correction values including a correction value set for the passage injector and a correction value set for the in-cylinder injector; and when the fuel injection amount of the other one of the injectors is less than or equal to the value that indicates the possibility of the fuel injection amount falling below the allowable lower limit value, the correction means sets the correction value of the one of the injectors to compensate for an amount of fuel injection that becomes excessive when the fuel injection amount of the other one of the injectors is not corrected.

3. The controller according to claim 2, wherein the correction means sets the correction value of the one of the injectors based on a ratio of the total fuel injection amount for the engine and the fuel injection amount of the one of the injectors.

4. The controller according to claim 2, wherein the correction means fixes the correction value of the other one of the injectors when the fuel injection amount of the other one of the injectors is less than or equal to the value that indicates the possibility of the fuel injection amount falling below the allowable lower limit value.

5. A control apparatus for controlling fuel injection in an engine, the engine including an intake passage, a combustion chamber, a passage injector for injecting fuel into the intake passage, and an in-cylinder injector for injecting fuel into the combustion chamber, the control apparatus comprising:

a controller for controlling the passage injector and the in-cylinder injector so that the passage injector and the in-cylinder injector allocate and inject fuel and for correcting the fuel injection amount for the engine with a correction value that is based on an air-fuel ratio in the engine, wherein the controller corrects a fuel injection amount of only one of the injectors among the passage injector and the in-cylinder injector with the correction value when the fuel injection amount of the other one of the injectors among the passage injector and the in-cylinder injector is less than or equal to a value that indicates the possibility of the fuel injection amount falling below an allowable lower limit value due to correction with the correction value.

6. The control apparatus according to claim 5, wherein:

the correction value is one of a plurality of correction values including a correction value set for the passage injector and a correction value set for the in-cylinder injector; and when the fuel injection amount of the other one of the injectors is less than or equal to the value that indicates the possibility of the fuel injection amount falling below the allowable lower limit value, the controller sets the correction value of the one of the injectors to compensate for an amount of fuel injection that becomes excessive when the fuel injection amount of the other one of the injectors is not corrected.

7. The control apparatus according to claim 6, wherein the controller sets the correction value of the one of the injectors based on a ratio of the total fuel injection amount for the engine and the fuel injection amount of the one of the injectors.

8. The control apparatus according to claim 6, wherein the controller fixes the correction value of the other one of the injectors when the fuel injection amount of the other one of the injectors is less than or equal to the value that indicates the possibility of the fuel injection amount falling below the allowable lower limit value.

9. A controller for controlling fuel injection in an engine, the engine including an intake passage, a combustion chamber, a passage injector for injecting fuel into the intake passage, and an in-cylinder injector for injecting fuel into the combustion chamber, wherein a fuel injection amount for the engine is corrected with a correction value that is based on an air-fuel ratio in the engine, the controller comprising:

a correction means for correcting a fuel injection amount of only one of the injectors among the passage injector and the in-cylinder injector with the correction value when the fuel injection amount of the other one of the injectors among the passage injector and the in-cylinder injector is less than or equal to a value that indicates a possibility of the fuel injection amount falling below an allowable lower limit value due to correction with the correction value; and at least one sensor in communication with the correction means for providing engine information.

10. A control apparatus for controlling fuel injection in an engine, the engine including an intake passage, a combustion chamber, a passage injector for injecting fuel into the intake passage, and an in-cylinder injector for injecting fuel into the combustion chamber, wherein a fuel injection amount for the engine is corrected with a correction value that is based on an air-fuel ratio in the engine, the control apparatus comprising:

a controller for correcting a fuel injection amount of only one of the injectors among the passage injector and the in-cylinder injector with the correction value when the fuel injection amount of the other one of the injectors among the passage injector and the in-cylinder injector is less than or equal to a value that indicates a possibility of the fuel injection amount falling below an allowable lower limit value due to correction with the correction value; and at least one sensor in communication with the controller for providing engine information.

11. A controller for controlling fuel injection in an engine, the engine including an intake passage, a combustion chamber, a passage injector for injecting fuel into the intake passage, and an in-cylinder injector for injecting fuel into the combustion chamber, the controller comprising:

a correction means for correcting a fuel injection amount for the engine with a correction value that is based on an air-fuel ratio in the engine; and a control means for fixing a fuel injection amount of one of the injectors among the passage injector and the in-cylinder injector to an allowable lower limit value and decreasing a fuel injection amount of the other one of the injectors among the passage injector and the in-cylinder injector when the fuel injection amount of the one of the injectors is less than an allowable lower limit value.

12. The controller according to claim 11, wherein the control means decreases the fuel injection amount of the other one of the injectors so as to offset an amount of fuel injection that becomes excessive when the fuel injection amount of the one of the injectors is fixed at the allowable lower limit.

13. The controller according to claim 12, wherein the control means decreases the fuel injection amount of the other one of the injectors by a difference between the fuel injection amount of the one of the injectors when fixed at the allowable lower limit and the fuel injection amount of the one of the injectors when not fixed at the allowable lower limit.

14. A control apparatus for controlling fuel injection in an engine, the engine including an intake passage, a combustion chamber, a passage injector for injecting fuel into the intake passage, and an in-cylinder injector for injecting fuel into the combustion chamber, the control apparatus comprising:

a controller for correcting a fuel injection amount for the engine with a correction value that is based on an air-fuel ratio in the engine, wherein the controller fixes a fuel injection amount of one of the injectors among the passage injector and the in-cylinder injector to an allowable lower limit value and decreases a fuel injection amount of the other one of the injectors among the passage injector and the in-cylinder injector when the fuel injection amount of the one of the injectors is less than an allowable lower limit value.

15. The control apparatus according to claim 14, wherein the controller decreases the fuel injection amount of the other one of the injectors so as to offset an amount of fuel injection that becomes excessive when the fuel injection amount of the one of the injectors is fixed at the allowable lower limit.

16. The control apparatus according to claim 15, wherein the controller decreases the fuel injection amount of the other one of the injectors by a difference between the fuel injection amount of the one of the injectors when fixed at the allowable lower limit and the fuel injection amount of the one of the injectors when not fixed at the allowable lower limit.

17. A controller for controlling fuel injection in an engine, the engine including an intake passage, a combustion chamber, a passage injector for injecting fuel into the intake passage, and an in-cylinder injector for injecting fuel into the combustion chamber, wherein a fuel injection amount for the engine is corrected with a correction value that is based on an air-fuel ratio in the engine, the controller comprising:

a control means for fixing a fuel injection amount of one of the injectors among the passage injector and the in-cylinder injector to an allowable lower limit value and decreasing a fuel injection amount of the other one of the injectors among the passage injector and the in-cylinder injector when the fuel injection amount of the one of the injectors is less than an allowable lower limit value; and at least one sensor in communication with the control means for providing engine information.

18. A control apparatus for controlling fuel injection in an engine, the engine including an intake passage, a combustion chamber, a passage injector for injecting fuel into the intake passage, and an in-cylinder injector for injecting fuel into the combustion chamber, wherein a fuel injection amount for the engine is corrected with a correction value that is based on an air-fuel ratio in the engine, the control apparatus comprising:

a controller for fixing a fuel injection amount of one of the injectors among the passage injector and the in-cylinder injector to an allowable lower limit value and decreasing a fuel injection amount of the other one of the injectors among the passage injector and the in-cylinder injector when the fuel injection amount of the one of the injectors is less than an allowable lower limit value; and at least one sensor in communication with the controller for providing engine information.

19. A method for controlling fuel injection in an engine, the engine including an intake passage, a combustion chamber, a passage injector for injecting fuel into the intake passage, and an in-cylinder injector for injecting fuel into the combustion chamber, the method comprising:

controlling the passage injector and the in-cylinder injector so that the passage injector and the in-cylinder injector allocate and inject fuel;

correcting the fuel injection amount for the engine with a correction value that is based on an air-fuel ratio in the engine; and correcting a fuel injection amount of only one of the injectors among the passage injector and the in-cylinder injector with the correction value when the fuel injection amount of the other one of the injectors among the passage injector and the in-cylinder injector is less than or equal to a value that indicates the possibility of the fuel injection amount falling below an allowable lower limit value due to correction with the correction value.

20. The method according to claim 19, wherein:

the correction value is one of a plurality of correction values including a correction value set for the passage injector and a correction value set for the in-cylinder injector; and said correcting a fuel injection amount of only one of the injectors includes setting the correction value of the one of the injectors to compensate for an amount of fuel injection that becomes excessive when the fuel injection amount of the other one of the injectors is not corrected.

21. The method according to claim 20, wherein said setting the correction value of the one of the injectors includes setting the correction value of the one of the injectors based on a ratio of the total fuel injection amount for the engine and the fuel injection amount of the one of the injectors.

22. The method according to claim 20, further comprising:

fixing the correction value of the other one of the injectors when the fuel injection amount of the other one of the injectors is less than or equal to the value that indicates the possibility of the fuel injection amount falling below the allowable lower limit value.

23. A method for controlling fuel injection in an engine, the engine including an intake passage, a combustion chamber, a passage injector for injecting fuel into the intake passage, and an in-cylinder injector for injecting fuel into the combustion chamber, the method comprising:

correcting a fuel injection amount for the engine with a correction value that is based on an air-fuel ratio in the engine; and fixing a fuel injection amount of one of the injectors among the passage injector and the in-cylinder injector to an allowable lower limit value and decreasing a fuel injection amount of the other one of the injectors among the passage injector and the in-cylinder injector when the fuel injection amount of the one of the injectors is less than an allowable lower limit value.

24. The method according to claim 23, wherein said decreasing a fuel injection amount of the other one of the injectors includes decreasing the fuel injection amount of the other one of the injectors so as to offset an amount of fuel injection that becomes excessive when the fuel injection amount of the one of the injectors is fixed at the allowable lower limit.

25. The method according to claim 24, wherein said decreasing the fuel injection amount of the other one of the injectors includes decreasing the fuel injection amount of the other one of the injectors by a difference between the fuel injection amount of the one of the injectors when fixed at the allowable lower limit and the fuel injection amount of the one of the injectors when not fixed at the allowable lower limit.

26. A method for controlling fuel injection in an engine, the engine including an intake passage, a combustion chamber, a passage injector for injecting fuel into the intake passage, and an in-cylinder injector for injecting fuel into the combustion chamber, wherein a correction value based on an air-fuel ratio is set for each of the passage injector and the in-cylinder injector, the method comprising:

correcting a fuel injection amount for the engine with the correction value;

determining whether a fuel injection amount of one of the injectors among the passage injector and the in-cylinder injector is less than a predetermined value when the passage injector and the in-cylinder injector are both injecting fuel;

changing the correction value of the one of the injectors when the fuel injection amount of the one of the injectors is less than a predetermined value; and fixing the correction value of the other one of the injectors among the passage injector and the in-cylinder injector when the fuel injection amount of the one of the injectors is less than the predetermined value.

27. The method according to claim 26, wherein said changing the correction value of the one of the injectors includes changing the correction value of the one of the injectors so as to compensate for the effect that the fixing of the correction value of the other one of the injectors has on the fuel injection amount of the engine.

28. A method for controlling fuel injection in an engine, the engine including an intake passage, a combustion chamber, a passage injector for injecting fuel into the intake passage, and an in-cylinder injector for injecting fuel into the combustion chamber, wherein a correction value based on an air-fuel ratio is set for each of the passage injector and the in-cylinder injector, the method comprising:

correcting a fuel injection amount for the engine with the correction value;

determining whether a fuel injection amount of one of the injectors among the passage injector and the in-cylinder injector is less than an allowable lower limit value when the passage injector and the in-cylinder injector are both injecting fuel;

fixing the fuel injection amount of one of the injectors among the passage injector and the in-cylinder injector when the fuel injection amount of the one of the injectors is less than an allowed lower limit value; and changing the correction value of the other one of the injectors among the passage injector and the in-cylinder injector when the fuel injection amount of the one of the injectors is less than the allowed lower limit value.

29. The method according to claim 28, wherein said changing the correction value of the other one of the injectors includes decreasing the fuel injection amount of the other one of the injectors so as to offset an amount of fuel injection that becomes excessive when the fuel injection amount of the one of the injectors is fixed at the allowable lower limit.

* * * * *